United States Patent [19]

Beiser

[11] 3,969,550

[45] July 13, 1976

[54] CHROMIZING PROCESS USING COLUMBIUM AS STABILIZER

[75] Inventor: Carl Adolph Beiser, Coraopolis

[73] Assignee: National Steel Corporation, Pittsburgh, Pa.

[22] Filed: Mar. 10, 1975

[21] Appl. No.: 557,177

Related U.S. Application Data

[63] Continuation-in-part of Ser. No. 387,627, Aug. 13, 1973, abandoned.

[52] U.S. Cl. ..... 427/253; 29/196.6; 148/31.5; 427/205

[51] Int. Cl.[2] ..... C23C 11/00; C23C 13/00

[58] Field of Search ..... 148/31.5; 75/123 J; 29/196.6; 427/253, 205

[56] References Cited

UNITED STATES PATENTS

| | | | |
|---|---|---|---|
| 2,255,482 | 9/1941 | Daeves et al. | 427/253 |
| 2,399,848 | 5/1946 | Becker et al. | 427/253 |
| 2,791,517 | 5/1957 | Becker et al. | 427/253 |
| 3,102,831 | 9/1963 | Tidale | 75/123 J |
| 3,222,212 | 12/1965 | Samuel et al. | 427/253 |
| 3,753,758 | 8/1973 | Shanley | 427/205 |
| 3,775,151 | 11/1973 | Baker et al. | 427/205 |

FOREIGN PATENTS OR APPLICATIONS

| | | |
|---|---|---|
| 86,406 | 10/1959 | Denmark |
| 968,320 | 2/1958 | Germany |

*Primary Examiner*—Harry J. Gwinnell
*Assistant Examiner*—Shrive P. Beck
*Attorney, Agent, or Firm*—Shanley, O'Neil and Baker

[57] ABSTRACT

An improved process for preparing chromized steel using a substrate which consists essentially of a flat rolled plain low carbon columbium treated steel initially having a total carbon content of at least 0.03% and containing about 0.03–0.15% columbium. The steel substrate is the flat rolled product of the solidification of molten steel having the above composition. The carbon content of the steel substrate is partially stabilized whereby a controlled portion of the carbon is free to diffuse upon heating to an elevated chromizing temperature. The carbon content which is free to diffuse, the columbium content, and the thickness of the substrate are carefully correlated whereby the overall quality of the chromized product prepared therefrom may be controlled and maintained at optimum levels. The invention further provides the improved chromized steel products prepared thereby.

21 Claims, No Drawings

CHROMIZING PROCESS USING COLUMBIUM AS STABILIZER

RELATED APPLICATION

This is a continuation-in-part of our copending application Ser. No. 387,627 filed Aug. 13, 1973 and now abandoned.

BACKGROUND OF THE INVENTION

The present invention is concerned with an improved process for preparing chromized steel. The invention is further concerned with a novel process for preparing chromized steel which utilizes an improved steel substrate. In still a further variant, the invention is concerned with the improved chromized steel products prepared by the process of the invention.

Chromized steel has surface layers about 1 – 3 mils in thickness of an iron-chromium alloy on a low carbon steel substrate. The alloy is formed by diffusing chromium into the surface of the steel substrate. This may be conveniently accomplished by heat treating the steel substrate at an elevated chromizing temperature, in a protective chromizing atmosphere and in the presence of a source of chromium and a chromizing energizer until a desired thickness of the chromized coating is produced. The resulting chromized coating has corrosion characteristics comparable to the 400 series of stainless steel and especially types 409 and 430. The chromized steel product is highly corrosion resistant and may be used as a low cost substitute for stainless steel.

High quality chromized steel is characterized by a substantially continuous corrosion resistant coating or diffusion layer of iron-chromium alloy having a metallographically measured thickness of about 1 – 3 mils and preferably about 2 mils. The appearance of the chromized steel surface should be pleasing to the eye and and substantially uniform in color without mottling or staining of portions of the surface area. The chromized steel surface should be smooth and free of sintered particles which adhere tightly and produce an unsatisfactory rough surface. The chromized steel product also must have good mechanical characteristics. An ASTM ferrite grain size of 3 or finer, a transition temperature no higher than +20°F., an elongation in two inches of at least 30%, a yield strength of at least 17,000 psi, a tensile strength of at least 35,000 psi, and excellent formability are very desirable. Formability is especially important as the chromized steel may be used to manufacture mufflers for automobiles and other corrosion resistant articles which require intricate forming operations. If the product does not have good formability with respect to both the iron-chromium alloy layer and the underlying substrate, then the corrosion resistant alloy layer is cracked during the forming step and the desirable corrosion resistant properties of the formed article are lost in the vicinity of the crack.

The chromized steel products produced heretofore have had the above described desirable characteristics to varying degrees. However, prior to the present invention, it was very difficult if not impossible to consistently produce an entirely satisfactory chromized steel product in a wide variety of thicknesses from the available steel substrates.

The present invention overcomes the above mentioned and other disadvantages of the prior art chromizing substrates by providing a plain low carbon columbium treated steel substrate having a controlled free or diffusable carbon content, columbium content and thickness which are carefully correlated as described more fully hereinafter. This substrate assures that a high quality chromized steel product possessing the above mentioned combination of desirable properties to a remarkable degree will be produced consistently with any desired substrate thickness.

It is an object of the present invention to provide an improved steel substrate which greatly improves the appearance and mechanical characteristics of chromized steel prepared therefrom.

It is a further object to provide a novel proscess for preparing chromized steel whereby the appearance and mechanical characteristics of the chromized steel product may be maintained at optimum levels and especially when employing a noncompacted coating of particulate chromium as the chromium source.

It is still a further object to provide the improved chromized steel products prepared in accordance with the chromizing process of the invention.

Still other objects and advantages of the invention will be apparent to those skilled in the art upon reference to the following detailed description and the illustrative examples.

DETAILED DESCRIPTION OF THE INVENTION INCLUDING PREFERRED VARIANTS AND EMBODIMENTS THEREOF

In the interest of convenience and clarity, the present invention will be described hereinafter with specific reference to the chromizing of relatively thin flat rolled steel shapes such as continuous strip and discrete sheets. The term "sheet material " as used herein is intended to embrace flat rolled continuous steel strip, discrete steel sheets and the like. It is understood that steel shapes having numerous other configurations may be chromized. It is only necessary that the steel substrate have the composition and properties described more fully hereinafter.

In practicing one presently preferred variant of the invention, steel sheet material is subjected to a prior art wet cleaning process for the removal of surface contaminants and then the cleaned sheet material is dried. A uniform film or coating of a volatilizable liquid having a halogen-containing energizer and/or binder therein may be applied on at least one surface of the clean dry sheet material, and the resulting wet sheet material may be passed through a powder deposition zone where a particulate coating pf powdered metallic chromium-containing material may be applied thereon. The freshly coated sheet material may be heated at an elevated temperature over a period of time sufficient to volatilize the liquid from the particulate coating. An adherent coating is formed upon volatilizing the liquid, and a plurality of layers of the sheet material may be assembled into a pack and processed without compacting the particulate coating. The resulting pack may be processed at an elevated chromizing temperature for a sufficient period of time to provide both sides of the strip with a diffused chromium-iron alloy layer, i.e., a chromized coating. As will be discussed in greater detail hereinafter, there are certain preferred procedures, conditions and materials which which may be employed to produce superior results in the steps of the above variant of the invention. It is also understood that various modifications and other preferred variants fo the invention may be described hereidnafter which do not necessarily include all of the aforementioned steps.

The steel sheet material may be subjected to the usual scrubbing and washing steps of the prior art for the removal of dirt, scale, oil, grease and other surface contaminants which would adversely affect the subsequent steps in the process. For example, the sheet material may be electrolytically treated as an anode and/or as a cathode in aqueous sulfuric acid. Sheet material cleaned in this manner may be washed in fresh water and dried, and it is then ready to be wetted with the liquid containing the energizer and/or binder.

The energizers to be used in practicing the present invention include those halogen-containing compounds and mixtures thereof known to be suitable as a halogen source in prior art chromizing processes. Numerous prior art energizers, which are sometimes referred to as carriers, are disclosed in U.S. Pat. No. 1,853,369; 3,163,553; 3,222,212 and 3,312,546. The halides of iron and/or the hydrated halides of iron are the presently preferred energizers. Specific examples include ferrous chloride, ferric chloride, ferric bromide, ferric iodide, and the mono-, di-, tri-, penta-, hexa- and other hydrates thereof, all of which are referred to collectively herein as iron halides. Ferrous and/or ferric chloride and the aforementioned hydrates of ferrous and/or ferric chloride are most preferred. Other metal halides include the fluorides, chlorides, bromides and/or iodides of manganese, cobalt, nickel, chromium, aluminum, and the alkali metals, and the hydrates thereof. The ammonium halides and especially ammonium chloride, are useful as energizers and may be used alone or in admixture with the foregoing energizers.

The energizer is preferably dissolved in a volatilizable normally liquid solvent which may be readily removed from the particulate coating by evaporation at ambient temperature or by heating at a moderately elevated temperature such as about 100°–400°F. Examples of volatilizable solvents include water, which is usually preferred for ferrous and/or ferric chloride and other water soluble energizers, alcohols and especially the lower alcohols containing 1–8 carbon atoms of which methyl, ethyl, propyl and isopropyl alcohol are preferred, normally liquid hydrocarbons and especially distillate petroleum fractions such as kerosene, naphtha and light fuel oil, halogenated normally liquid hydrocarbons boiling below about 400°F. and especially those containing about 1–8 carbon atoms, and normally liquid ketones boiling below about 400°F. and especially those containing about 3–8 carbon atoms.

It is not always necessary that the energizer be dissolved in the volatilizable liquid. For example, in some instances the volatilizable liquid may contain a finely divided suspension of the energizer, and the suspension may be applied to the surface of the sheet material.

The concentration of the energizer in the volatilizable liquid solvent may vary over wide ranges, such as, for example, from at least 10–100 g/l up to 500–1000 g/l or up to the amount required to produce a saturated solution of the energizer. In general, it is only necessary that the energizer be present in a concentration to assure that the quantity of liquid to be applied on the substrate surface will deposit the desired amount of the energizer upon evaporation. The solution may be applied in an amount to wet the surface with a uniform film of liquid and the concentration of the energizer is adjusted to provide approximately 1–20 grams, and preferably about 2–6 grams of the energizer per square foot per side of surface area to be wetted. The weight ratio of the metallic chromium content of the particulate coating to the energizer is preferably from about 1:1 or 2:1 to 6:1, but it may be up to about 10:1 or higher. The solution may be applied to only one surface or to both surfaces of the sheet material. The solution may be applied to one side only by spraying or other suitable techniques such as by using wetted rolls. In instances where the solution is applied to both surfaces, then the sheet material may be immersed in a body of the solution, followed by withdrawing the wet sheet material from the solution and passing it between squeegee or metering rolls to remove excess liquid. The substrate surface should be uniformly wetted with a thin film of the solution without pooling or run off of liquid for best results, and preferably the solution is applied on one or both sides of the substrate by spraying a controlled amount of solution or by contacting with wetted grooved rolls having a controlled amount of the solution thereon. In instances where the solution is too dilute to apply the desired amount of the energizer in one application, then a plurality of applications may be made followed by evaporation of solvent between stages, with the exception of the last stage as the sheet material should be wetted with the solution during the application of the metallic chromium containing material in the coating step which follows. Applying the energizer to both sides of the substrate permits better control and overcomes many practical problems of application. More dilute solutions may be used to apply a given weight of energizer per unit weight of metallic chromium without the problem of run off or pooling of the solution discussed above, or blistering of the coating during drying.

It is possible to employ impure mixtures which include an energizer. One mixture which produces unusually good results is spent hydrochloric acid pickle liquor that is produced in the commerical hydrochloric acid pickling of ferrous metal. The spent pickle liquor contains some free hydrochloric acid, and substantial amount of ferrous and/or ferric chloride in the form of their hydrates. It may be used as produced in normal steel mill operations, but preferably it is concentrated by evaporation so as to increase the concentration of the ferrous and/or ferric chloride contents. Spent hydrochloric acid pickle liquor which has been concentrated by evaporation to a specific gravity of approximately 1.3–1.4 grams per cc. or higher produces exeptionally good results. If desired, additional ferrous and/or ferric chloride may be added to the pickle liquor as produced or after concentration so as to increase the concentration of the energizer. For example, ferrous chloride tetrahydrate may be present in the energizer solution in a total amount of 500–1000 g/l or more.

The source of metallic chromium may be commercially pure chromium, or chromium alloyed with metals which do not have an adverse effect on the chromizing process. Ferrochromium is usually preferred and for best results it should have a carbon content of 0.05% or less. Chromium-nickle or chromium-nickel-iron alloys in general, and especially alloys containing the chromium and nickel in approximately the ratios existing in prior art stainless steels, are also very useful and are embraced within the term metallic chromium source materials for the purposes of the invention. Nickel powder also may be codeposited with the source of chromium to provide desired chromium-nickel weight ratios such as those existing in prior art stainless steels. The metallic chromium content of the source material should be at least 20%, and for better results at least 50%. In instances where ferrochromium is employed, the chromium content is preferably at least 70% and commercial ferrochromium containing about 72–84% chromium is very satisfactory.

The source of metallic chromium may be in particulate form and the particles are of a size useful in the selected method of application. While a number of methods of application are suitable, it is usually preferred to contact the substrate surface with a gaseous suspension of the dry metallic particles under conditions whereby they are directed onto the wet surface. Methods suitable for applying dry finely divided materials disclosed herein, such as the source of chromium, include electrostatic deposition, or use of a vibrating table, a metering drum, or a fluidized bed. The presently preferred method is by electrostatic deposition using prior art apparatus and techniques described in the literature and patents such as U.S. Pat. No. 3,090,353 and the patents mentioned hereinbefore. In instances where the substrate surface is contacted with an aerosol of the chromium containing particles, then the particle size (Tyler screen) should not be greater than about number five mesh, and preferably should not be greater than about number 30 mesh. commercially available particles having a Tyler screen size between approximately minus 30 mesh and minus 350 mesh, preferably about minus 90–200 mesh, and for best results minus 150 to minus 200 mesh are very satisfactory and are practical particle sizes which are useful for producing uniform coatings by well known prior art electrostatic deposition processes.

The chromium-containing material is deposited on the ferrous metal substrate in an amount to provide a desired weight of metallic chromium per unit of surface area. In instances where the source has a relatively low chromium content, then the amount of the deposited coating is adjusted accordingly to provide the desired weight of metallic chromium. As a general rule, the metallic chromium content of the coating should be at least 5 grams per square foot of surface area to be chromized and preferably at least 9 to 10 grams. Better results usually are produced when the coating contains about 11–15 grams of chromium per square foot of surface area to be chromized and the coating weight may be increased as desired up to the upper limit, which is approximately 35 to 50 grams of metallic chromium per square foot of surface area to be chromized. It is understood that the coating weights are given on a per side basis and are based on the metallic chromium content thereof.

The particulate source of chromium is applied to the substrate while it is still wet with the solution of energizer and/or binder, and preferably immediately after application of the solution. When applied in this manner, the solution acts as a temdporary binder for the metal particles. The particles are deposited and retained on the wet surface in the form of a uniform particulate chromium coating, and a more uniform chromized layer is produced on the substrate.

The liquid content in the green particulate coating may be removed by heating at an elevated temperature. This may be conveniently accomplished by passing the coated substrate through an oven maintained at a temperature high enough to cause rapid evaporation of the liquid and preferably above the boiling point for a sufficient period of time to dry the substrate surface. When water is the liquid a temperature of about 200°–350°F. and preferably about 260°–300°F. is satisfactory and the substrate may be heated for about 5 seconds to about 15 minutes to assure substantially complete evaporation of the water and loss of at least some water of hydration when present in the energizer. For example, the water of hydration in ferrous chloride tetra- or hexa-hydrate may be reduced to the mono- or dihydrate, and this is desirable as substantially all water should be removed before commencing the chromizing step. The removal of the liquid produces an adherent particulate coating on the substrate containing the energizer and the source of chromium. Surprisingly, selected energizers such as the iron halides are sufficiently effective as a binder to prevent the chromium particles from being removed readily from the dried coated surface by rubbing with the fingers. Also, the dried coated surface may be coiled or passed under a roll without substantial loss of the particulate chromium coating and a compacting step is not necessary.

A plurality of layers of the dried coated sheet material are assembled into a pack for chromizing the surfaces thereof, with the adjacent layers or convolutions of the sheet material having at least one adherent particulate chromium coating therebetween. In instances where the sheet material is in the form of discrete sheets, this may be conveniently accomplished by stacking the dried coated sheets in superimposed relationship without compacting the coating. When the sheet material is in the form of continuous strip, the dried coated strip is coiled without compacting the metallic chromium-containing particles in the coating. The strip may be coiled under a line tension of approximately 50–200 pounds per inch of width of the strip, and this amount of coiling tension results in the particulate coating being held in close contact with adjacent convolutions of the strip without resulting in compacting or deforming of the particles in the coating to any substantial extent.

The packs prepared from the dried coated sheet material are subjected to a heat treatment cycle under prior art chromizing conditions in a protective atmosphere. Preferably, the packs are placed in a closed vessel which is provided with an exhaust conduit and conduits for supplying desired gases thereto to purge air from the vessel with nitrogen or an inert gas, and to maintain a protective atmosphere. Heating means is provided for maintaining the vessel at a desired temperature over the heat treatment cycle. In one suitable heat treatment cycle, air is replaced with argon or nitrogen, then the argon or nitrogen atmosphere is replaced with a protective atmosphere including hydrogen or a mixture of hydrogen and argon or other inert gas, and the packs are heated to approximately 600°–800°F. and preferably to about 650°–750°F. while passing the protective atmosphere through the vessel to remove volatiles. This temperature may be held for approximately 5–25 hours and preferably for about 10 hours or until the dew point of the furnace atmosphere is about 30°F. or less. After the purging is completed, the temperature is raised to approximately 1550°–1850°F. and preferably to about 1725°–1750°F., and this chromizing temperature is held for a sufficient period of time to chromize the sheet metal surfaces. For example, the chromizing temperature may be held for 10–80 hours and preferably about 20–50 hours. During this period of time, the vessel is not purged and the atmosphere is maintained at a positive pressure of 1–2 inches of water. The atmosphere in the vessel may be pure hydrogen or a mixture of an inert gas such as argon or helium and hydrogen. During the chromizing step, the energizer provides halogen between the adjacent layers of sheet material. As is well understood in the art, the halogen aids and promotes the chromizing of the adjacent surfaces in a minimum period of time.

After the chromizing step has been completed, the temperature is lowered to approximately 650°–750°F. or below and the hydrogen-containing protective atmosphere may be replaced with gaseous argon or nitrogen. After reducing the temperature still further to approximately 300°–400°F. or below, the furnace may be opened and the chromized sheet material is removed. The chromized sheet material is subjected to washing with water sprays and/or is contacted with mechanically driven brushes to remove residual chemicals and inert filler when present. Thereafter, the chromized sheet material may be brushed or given other mechanical treatment to produce a lustrous finish and/or it may be temper rolled.

The process of the invention is especially useful for producing steel substrates with a diffused or chromized layer having a thickness of about 0.0005–0.01 inch, and preferably about 0.001–0.003 inch. Sheet material with chromized coating having a thickness of 0.0015–0.0025 inch is especially useful in many commercial applications and may be easily produced. The average chromium content in the chromized layer preferably should be between about 12 and 30%, and for best results is between about 18 and 25%.

The process of the invention may be readily adapted to the operation of continuous strip coating lines of prior art construction, and especially high speed lines of prior art construction, and especially high speed lines which operate at strip speeds of several hundred feet per minute and higher wherein the critical treatments to produce the adherent coating are performed while the strip travels in a substantially straight line. The strip is continuously uncoiled and is passed through successive zones for wet cleaning the strip, drying the cleaned strip, applying a solution of an energizer and/or binder on the top surface of the dried strip and preferably also on the bottom surface, electrostatically depositing the particulate source of chromium on at least the top surface of the wet strip and if desired also on the under surface, drying the coated strip by heating at 200°–350°F. for about 1–60 seconds and preferably about 5–30 seconds to remove the solvent content of the solution and at least a portion of the water of hydration when present and form an adherent particulate coating in the absence of compaction, and then coiling. The strip is preferably passed horizontally through the electrostatic deposition zone and through the oven without being contacted by a roll on the chromium-coated side, whereby the particulate chromium coating on the upper surface is not disturbed prior to drying the solution and coiling. When using an energizer which has an adhesive characteristic under the drying conditions, such as ferrous chloride and other iron halides, it is not necessary to apply a separate binder prior to the coating step as the solution of energizer is an excellent binder and a uniform adherent particulate coating is formed. Also, it is not necessary to apply a particulate coating on the under surface of the strip and this simplifies the process and less coating equipment is required.

The solution of energizer is preferably applied to both sides of the sheet material so as to form, after evaporation of the solvent, a dry layer thereof on both sides. This is of importance as upon heating packs assembled therefrom to the chromizing temperature, the halogen content of the energizer is available for immediate reaction with the layer of chromium containing particles and/or the ferrous metal surfaces. While all of the reasons therefor are not fully understood at the present time, the presence of a coating of energizer in direct contact with the steel substrate surface on one side, and preferably on both sides, provides many advantages. A coating of energizer in direct contact with the steel surface on both sides is very beneficial on the chromium-free side of the substrate when only one side is coated with the source of chromium. However, good results may be obtained by applying the energizer on the top surface only of the strip.

In instances where the energizer does not have an adhesive characteristic under the process conditions, it may be desirable to apply a separate binder to the substrate surface. A binder may be applied to the upper and/or lower surfaces of the sheet material before, during or after applying the energizer to form or to aid in forming an adherent particulate chromium coating. The binder has an adhesive characteristic under the process conditions and prior art binders may be used in the same manner and quantitites as disclosed in the prior art. The binder may be applied in a dry state such as in the form of finely divided powder, or in a liquid state such as in the form of a solution, in quantities sufficient to form a tacky surface under the chromium coating conditions. Examples of suitable prior art binders include 1–10% and preferably 2–5% aqueous solutions of sodium silicate, methyl cellulose and polymers such as polyvinyl pyrrolidone. The binder solution may be applied separately to the substrate surface as a thin film or a soluble binder may be added to the energizer solution and applied along with the energizer as discussed previously. The other steps in the process discussed hereinbefore may remain the same. It is understood that a prior art energizer is present in the pack at the time of chromizing and it may be added in dry powdered form, as a solution, or as a gas by any convenient prior art method. For example, a halogen-containing gas may be fed to the closed vessel at the time of chromizing, or a dry powdered energizer or a solution of an energizer may be applied to the sheet material by any suitable convenient method before, during or after coating with the adherent particulate chromium-containing coating.

In instances where the adherent powdered chromium coating is applied only to the upper surface of the strip, surprisingly it is still possible to chromize both surfaces. When desired, open coil annealing may be employed for the chromizing step when the substrate is coated with chromium on one or both sides.

It is not necessary to use an inert filler, but one may be used when desired. Examples of inert fillers include aluminum oxide, magnesium oxide, kaolin, bentonite and other inert refractory materials. The filler should be finely divided, and it may have a particle size of minus 100–325 mesh and preferably about minus 200 mesh (Tyler screen). The filler may be applied in an amount of about 5–50% by weight, and preferably about 15–20% by weight, of the source of chromium. The preferred method of applying the filler is by electrostatic deposition, but other suitable methods may be used.

The selection of an aqueous solution containing iron halide as a binder-energizer and a high speed commerical line for electrostatcially depositing the particulate source of chromium and forming an adherent coating thereof on continuous ferrous metal strip offers many advantages in the economic production of chromized steel strip. In coating lines of this type, the strip moves at linear speeds of several hundred feet per minute and higher. The time available for removing the water from the film of solution on the strip surface is very limited, and usually is less than 30 seconds to 1 minute. As a result, the volume of solvent in the energizer solution must be limited to the amount that can be evaporated within the time available without forming blisters and other imperfections in the dried particulate coating, and yet the solution must contain sufficient iron halide to be effective as an energizer under the chromizing conditions. Also, the volume of solution should not exceed the amount required to form a thin uniform film on the strip surface, and quantitites sufficient to cause run off or pooling of liquid on the strip surface should be avoided.

When using an aqueous solution of ferrous chloride and other iron halides in the foregoing environment the volume of solution that can be applied must be held within relatively narrow limits. However, it is possible to vary the iron halide concentration as necessary to deposit a controlled amount of iron halide per unit of surface area, and thereby maintain the most effective weight ratio of energizer to metallic chromium in the adherent particulate coating. The volume of water in the thin uniform film of solution remains substantially constant per unit of surface area even when a large amount of energizer is applied, and the volume is sufficiently small to allow the water to be evaporated within the time available without forming blisters in the applied particulate coating. By applying the energizer solution to both sides of the substrate, the surface area wetted with the film of solution is doubled and this permits better control. More dilute solutions may be used for applying a given amount of energizer, and a greater volume of the solution may be applied per unit weight of metallic chromium without run off or pooling of the solution, or blistering of the coating during drying. Higher ratios of energizer to metallic chromium are also possible, and many practical problems of applying the energizer are overcome. The resulting steel strip has a uniform adherent coating thereon which contains a controlled highly effective weight ratio of the energizer to metallic chromium. It is only necessary to coil the coated strip to form a pack for chromizing, and thus the processing steps are reduced to a minimum.

The substrate for preparing chromized steel consists essentially of plain low carbon columbium treated steel containing carbon, manganese, silicon, sulfur and phosphorus in the amount set out below and the remainder iron and incidental impurities. The steel has a total carbon content of at least 0.03% initially and as further defined by the equation appearing hereinafter, usually the total carbon content is not greater than about 0.20%. The manganese content is conventional for low carbon steels and may be, for example, 0.20–1.50% and is preferably about 0.30–0.75%. Residual silicon, aluminum, sulfur and phosphorus are present in amounts conventional in plain low carbon steel. For semikilled steel the residual silicon content may be a maximum of 0.10 % and is preferably a maximum of 0.06%. For killed steel the residual aluminum content may range from 0.02% to 0.10% and is preferably in the 0.03 to 0.06% range. The sulfur and phosphorus contents are not greater than about 0.04–0.05%. The columbium content is about 0.03–0.15% and is further defined by the equation appearing hereinafter. A columbium addition may be made to the molten steel in the ladle in a quantity sufficient to provide the desired columbium content.

The carbon content is partially stabilized by the columbium addition so that a controlled portion thereof is free to diffuse into the chromized layer upon heating the steel substrate to an elevated chromizing temperature. Thus the steel substrate is heat treatable at an elevated chromizing temperature, in a protective chromizing atmosphere and in the presence of a source of chromium and a chromizing energizer to produce a carbon containing chromized coating or diffusion layer thereon having a metallographically measured thickness of about 1–3 mils, and preferably about 2 mils, within a practical period of heat treatment at the chromizing temperature such as about 20 hours. The chromized coating or diffusion layer that is formed contains the carbon initially present in the steel substrate which is free to diffuse under the chromizing conditions. It is essential that the carbon content of the chromized coating be about 0.2–1% and preferably about 0.25–0.50%. Sintering of chromium particles to the substrate surface, and staining and mottling of the chromized surface are problems when the substrate does not contain sufficient diffusible carbon (at least about 0.2%) to provide the minimum carbon content in the chromized coating. In instances where the chromized coating contains more than 1% of carbon, then unsatisfactory results are also obtained as the chromized coating is brittle and cannot be formed drastically when preparing articles from the chromized steel produce. It is therefore apparent that the diffusible carbon content of the steel substrate must be maintained within well defined critical limits in order to achieve acceptable results. It is also essential that the steel substrate contain sufficient columbium to react with or stabilize a controlled portion of the carbon and thereby improve the mechanical properties by providing insoluble finely divided particles of columbium carbide disbursed throughout the steel. This results in a finer ferrite grain structure in the substrate, a lower transition temperature, increased elongation and formability, and higher tensile and yield strengths. It has been discovered that the carbon content of the steel which is free to diffuse, the columbium content of the substrate, and the thickness of the steel substrate, which determines the amount of the surface area per unit volume of substrate, must be correlated to satisfy the equation $$A = Y \times Z,$$

where $A$ is the percent carbon content of the chromized coating and varies between 0.2% and 1%, $Y$ is the percent carbon content of the steel substrate which is free to diffuse and is determined by the following equation $$\%\text{Diffusible Carbon} = \%\text{ Total Carbon} - \left[\frac{\%\text{ Columbium Content}}{8} + \frac{0.01\%}{1}\right]$$

and $Z$ is a multiplication factor determined by the equation $$\text{Multiplication Factor} = \frac{\text{The steel substrate thickness in mils}}{\text{The total chromized coating thickness of the steel substrate in mils}}$$

where the total chromized coating thickness of the steel substrate is equal to twice the metallographically measured diffusion layer of the chromized coating plus 1 mil.

The amount of carbon which is free to diffuse is of critical importance. The diffusible or free carbon controls the surface appearance and where A in the equation drops below 0.2% the surface appearance is unsatisfactory. The carbon which is stabilized or combined with the columbium controls the grain size and mechanical characteristics of the chromized steel substrate. The thickness of the steel substrate affects the amount of carbon present, including the amount of free or diffusible carbon that is present per unit of surface area and must be considered in providing a steel substrate which will produce a chromized steel product having optimium properties. Steel substrates satisfying the equation set out above are unique due to the carefully controlled correlation of the free or diffusible carbon content of the substrate, the columbium content of the substrate and the thickness of the substrate.

In most instances, it is preferred that the substrate be in the form of a flat rolled product such as continuous strip or sheet but this is not essential. For example, solidified molten steel having a composition as defined herein may be hot and/or cold worked to produce shapes having any desired configuration. Also, the initially produced shapes may be formed into articles prior to chromizing.

The thickness of the substrate may vary over wide ranges provided the equation set out above is satisfied. For most uses, the substrate has a thickness between about 0.0003 inch and one-fourth inch, and preferably between about 0.01 inch and one-eighth inch. Blackplate of tinplate gage is satisfactory, as are heavier flat rolled sheet material stocks useful in the manufacture of automobile mufflers, bumpers, panels and the like.

Steel substrates having thicknesses varying between about 0.02 inch and 0.060 inch preferably have a total carbon content of 0.04–0.06% and a columbium content of 0.05–0.08%. In such instances, the steel may be prepared by adding approximately 2–3 pounds of columbium per ton to a ladle of rimmed, semikilled or killed steel having a carbon content of about 0.04–0.06%. The resulting columbium treated steel may be cast either into ingot molds or directly into slabs by continuous casting and then hot and cold rolled to produce flat rolled strip or sheet of a desired thickness. Preferably, the substrate is rolled thicker at the lower end of the carbon range and thinner at the upper end of the carbon range so as to satisfy the above equation in all instances. The steel substrate of the invention may be used in any suitable chromizing process.

When using the steel substrate of the invention, a formable chromized steel product is produced which has a yield strength of at least 17,000 psi and usually 19,000–23,000 psi, a tensile strength of at least 35,000 psi and usually 36,000–42,000 psi, an elongation of at least 30% and usually at least 35%, a transition temperature not greater than +20°F. and usually 0°F. or below, and an ASTM ferrite grain size of 3 or finer, and often up to 7 or finer.

The chromized steel products prepared by the process of the invention have fully as good corrosion resistance as type 430 stainless steel and are very resistant to pitting in the standard synthetic muffler condensate test. The chromized steel is also able to withstand prolonged exposure in air at temperatures up to 1250°F. Tensile elongations of up to 25% and bend radii of 3 times the thickness may be imposed on the chromized steel without affecting the corrosion resistance and oxidation characteristics. The chromized steel is uneffected by outdoor exposure over long periods of time. The chromized steel may be welded, and preferably with a stainless filler rod so that the resulting joint will have a continuous corrosion resistant layer. The chromized steel also may be resistant spot welded with ease.

The foregoing detailed description and the following specific example are for purposes of illustration only, and are not intended as being limiting to the spirit or scope of the appended claims.

EXAMPLE

This example illustrates the chromizing of a series of five coils of cold rolled columbium treated plain low carbon steel strip (see appended table) using an aqueous solution of ferrous chloride as a binder for the powdered ferrochromium coating. The general chromizing procedure used for each coil is set out below and the data thus obtained are given thereafter.

The steel strip was electrolytically cleaned in an aqueous alkaline solution of known type following prior art practices, rinsed in fresh water to remove the alkaline cleaning solution, pickled in aqueous sulfuric acid, rinsed in fresh water to remove the excess pickle solution, and dried. The clean strip was passed between sprays and an aqueous solution containing approximately 90 grams of ferrous chloride tetrahydrate per 100 milliliters of water was applied in an amount to wet the upper and lower surfaces. The wet strip was passed between rubber wringer rolls to distribute the solution over the upper and lower surfaces in the form of a uniform liquid film which, upon drying, deposited a coating thereon containing four grams per square foot per side when calculated as ferrous chloride dihydrate.

The wet strip was passed through a horizontal electrostatic deposition zone and powdered ferrochromium having a chromium content of about 70% was electrostatically deposited on the upper strip surface in the presence of the liquid film of solution. The powdered ferrochromium was uniformly deposited on the upper surface of the strip in an amount to provide about 12 of metallic chromium per square foot per side. grams of The coated strip emerging from the electrostatic deposition zone was passed horizontally through an infrared oven and heated therein to a temperature of 250°F. The water content of the solution was removed in the oven without forming blisters or other imperfections in the coating due to escape of the water vapor. Part of the water of hydration in the ferrous chloride tetrahydrate also was removed and the resulting dried ferrous chloride contained approximately 1 to 2 molecules of water of hydration per molecule of ferrous chloride. The dry particulate coating of ferrochromium of the strip was adherent and could not be readily removed by rubbing with the fingers. The adherent ferrochromium coating was not removed upon coiling the strip and the particles remained uniformly distributed across the strip surfaces in the quantities applied. The spaced raised particles on the strip surface prevented direct contact between the ferrous metal surfaces of adjacent convolutions in the coil and a refractory separator was not needed to prevent welding.

The coil of dried coated strip was placed in a furnace provided with an exhaust conduit and conduits for supplying a protective atmosphere, and the furnace was closed off from the surrounding atmosphere. The air initially present in the closed furnace was purged by passign gaseous argon therethrough. After removal of the air, the argon atmosphere was replaced with a protective argon and hydrogen-containing atmosphere. The furnace was heated to 750°F. and this temperature was held for 10 hours. During the 10 hour period, the pressure within the furnace was maintained at substantially atmospheric pressure while purging the volatile materials from the furnace. The temperature was then raised to 1750°F. without further purging, and this temperature was held for 20 hours. A protective argon and hydrogen atmosphere was maintained within the furnace at a positive pressure of 1 to 2 inches of water and holding at 1750°F. over the 20 hour period resulted in the chromizing of both surfaces of the strip. At the end of the 20 hours, the furnace was cooled to 400°F. and the argon and hydrogen atmosphere was replaced with an argon atmosphere. The furnace was then cooled to 350°F. and opened to remove the coil of chromized strip. The chromized strip was uncoiled, washed with water to remove residual chemicals, brushed to remove unused chromium particles and give a lustrous finish, and temper rolled.

Panels prepared from the chromized strip successfully passed the muffler laboratory test procedure No. 461-H-83, dated June 25, 1956, prescribed by the Corrosion Laboratory of the Engineering Division of the Chrysler Corporation. However Coil 2 had a stained surface. This coil failed to fall within the formula $A = Y \times Z$ because the columbium content of the substrate was high in relation to the carbon content. Specific data relating to the five coils appear in the following table.

| COIL | Substrate Thickness (inches) | Substrate Analysis (%) C | Substrate Analysis (%) Cb | Chromized Coating Analysis (%) Cr | Chromized Coating Analysis (%) C | Metallographic Coating Thickness (mils) | Total Coating Thickness (mils) | Free Carbon % |
|---|---|---|---|---|---|---|---|---|
| 1 | 0.035 | 0.04 | 0.032 | 23.0 | 0.24 | 1.5 | 4.0 | 0.028 |
| 2 | 0.035 | 0.04 | 0.120 | 21.1 | 0.14 | 1.6 | 4.2 | 0.015 |
| 3 | 0.035 | 0.07 | 0.059 | 26.0 | 0.57 | 1.4 | 3.8 | 0.059 |
| 4 | 0.035 | 0.07 | 0.074 | 25.4 | 0.48 | 1.6 | 4.2 | 0.056 |
| 5 | 0.060 | 0.06 | 0.086 | 29.9 | 0.94 | 1.6 | 4.2 | 0.044 |

| Multiplication Factor | Calculated Carbon in Coating (%) | Yield Strength (1000 psi) | Tensile Strength (1000 psi) | % Elongation in 2 Inches | Transition Temperature (°F.) | ASTM Grain Size |
|---|---|---|---|---|---|---|
| 8.8 | 0.25 | 22.2 | 39.6 | 35 | −80 | 3.5–5.5 |
| 8.3 | 0.12 | 22.6 | 43.0 | 35 | −160 | 6–8 |
| 9.2 | 0.54 | 21.8 | 38.5 | 33 | −30 | 2–5 |
| 8.3 | 0.46 | 20.9 | 37.6 | 31 | −20 | 2–5 |
| 14.3 | 0.63 | 21.5 | 38.5 | 38 | −70 | 2–5 |

I claim:

1. In a process for preparing chromized ferrous metal wherein a ferrous metal substrate is heat treated at an elevated chromizing temperature in a protective chromizing atmosphere in the presence of a source of chromium and a chromizing energizer until a corrosion resistant chromized coating is produced thereon, the improvement in combination therewith which comprises employing as the said ferrous metal substrate a plain low carbon columbium treated steel substrate initially having a total carbon content of at least 0.03% and containing about 0.03–0.15% of columbium, the carbon content of the steel being partially stabilized by the columbium whereby a portion of the carbon content is free to diffuse upon heating the steel substrate to the said elevated chromizing temperature, the steel substrate being heat treatable at the said elevated chromizing temperature in the protective chromizing atmosphere in the presence of the source of chromium and the chromizing energizer to produce a carbon-containing chromized coating thereon having a metallographically measured thickness of about 1–3 mils, the said chromized coating containing about 0.2–1% carbon from the steel substrate which is free to diffuse, and the said carbon content which is free to diffuse, the columbium content and the thickness of the steel substrate being correlated to satisfy the equation $$A = Y \times Z,$$

where $A$ is the percent carbon content of the said chromized coating and varies between 0.2 and 1%, $Y$ is the percent carbon content of the steel substrate which is free to diffuse and is determined by the following equation $$\%\text{Diffusible Carbon} = \%\text{ Total Carbon} - \left[\frac{\%\text{ Columbium Content}}{8} + \frac{0.01\%}{1}\right]$$

and $Z$ is a multiplication factor determined by the equation $$\text{Multiplication Factor} = \frac{\text{The steel substrate thickness in mils}}{\text{The total chromized coating thickness of the steel substrate in mils}}$$

where the total chromized coating thickness of the steel substrate is equal to twice the metallographically measured diffusion layer of the said chromized coating plus one mil.

2. The process of claim 1 wherein said steel substrate is prepared from steel selected from the group consisting of semikilled steel, capped steel, rimmed steel and steel killed with aluminum.

3. The process of claim 1 wherein said A varies between about 0.25 and 0.50%.

4. The process of claim 1 wherein the said total carbon content of the steel substrate is 0.04–0.06% and columbium content is 0.06–0.08%.

5. The process of claim 4 wherein the thickness of the said steel substrate is about 0.020–0.060 inch.

6. The process of claim 5 wherein said steel substrate is prepared from steel selected from the group consisting of semikilled steel, capped steel, rimmed steel and steel killed with aluminum.

7. The process of claim 6 wherein said A varies between 0.25 and 0.50%.

8. A process for preparing chromized steel sheet material comprising applying an adhesive composition on at least one surface area of steel sheet material, applying without compaction a particulate coating of a substantially dry particulate source of chromium on at least one surface area of the steel sheet material having the adhesive composition thereon, the adhesive composition having an adhesive characteristic under the conditions of applying the coating and forming an adherent particulate coating of the source of chromium on the surface of the steel sheet material in the absence of compaction, assembling a plurality of layers of the coated steel sheet material into a pack for chromizing the surfaces thereof, the adjacent layers of the sheet material in the pack having at least one adherent particulate coating of the source of chromium therebetween, and subjecting the pack to an elevated chromizing temperature to chromize the surfaces of the sheet material, the pack being in a protective atmosphere and a halogen-containing energizer being present therein while the sheet material is being chromized, the said steel sheet material consisting essentially of a flat rolled plain low carbon columbium treated steel initially having a total carbon content of at least 0.03% and containing about 0.03–0.15% of columbium, the carbon content of the steel being partially stabilized by the columbium whereby a portion of the carbon content is free to diffuse upon heating the sheet material to an elevated chromizing temperature, the sheet material being heat treatable at an elevated chromizing temperature in a protective chromizing atmosphere in the presence of a source of chromium and a chromizing energizer to produce a carbon-containing chromized coating thereon having a metallographically measured thickness of about 1–3 mils, the said chromized coating containing carbon from the steel sheet material which is free to diffuse, and the said carbon content which is free to diffuse, the columbium content and the thickness of the steel sheet material being correlated to satisfy the equation $$A = Y \times Z,$$

where $A$ is the percent carbon content of the said chromized coating and varies between 0.2 and 1%, $Y$ is the percent carbon content of the sheet material which is free to diffuse and is determined by the following equation $$\%\text{Diffusible Carbon} = \%\text{ Total Carbon} - \left[\frac{\%\text{ Columbium Content}}{8} + \frac{0.01\%}{1}\right]$$

and $Z$ is a multiplication factor determined by the equation $$\text{Multiplication Factor} = \frac{\text{The sheet material thickness in mils}}{\text{The total chromized coating thickness of the sheet material in mils}}$$

where the total chromized coating thickness of the sheet material is equal to twice the metallographically measured diffusion layer of the said chromized coating plus 1 mil.

9. The process of claim 8 wherein said sheet material is prepared from steel selected from the group consisting of semikilled steel, capped steel, rimmed steel and steel killed with aluminum.

10. The process of claim 8 wherein said A varies between about 0.25 and 0.50%.

11. The process of claim 8 wherein the said total carbon content of the sheet material is 0.04–0.06% and the columbium content is 0.06–0.08%.

12. The process of claim 11 wherein the thickness of the said sheet material is about 0.020–0.060 inch.

13. The process of claim 12 wherein said sheet material is prepared from steel selected from the group consisting of semikilled steel, capped steel, rimmed steel and steel killed with aluminum.

14. The process of claim 13 wherein said A varies between 0.25 and 0.50%.

15. A process for preparing chromized steel sheet material comprising applying a coating of liquid composition including a volatilizable liquid and a halogen-containing energizer on steel sheet material to wet the surface, applying without compaction a particulate coating of a substantially dry particulate source of chromium on the surface of the sheet material wetted with said liquid composition, drying the coated sheet material to remove the volatilizable liquid from the coating and produce dried sheet material with an adherent coating thereon containing the energizer and the particulate source of chromium, said liquid composition having an adhesive characteristic under the drying conditions whereby an adherent coating containing the energizer and particulate source of chromium is formed on the dried sheet material in the absence of compaction, assembling a plurality of layers of the dried coated sheet material into a pack for chromizing the surfaces thereof, the adjacent layers of the dried sheet material in the pack having at least one adherent coating containing the energizer and the particulate source of chromium therebetween, and subjecting the pack to an elevated chromizing temperature in a protective atmosphere to chromize the surfaces of the sheet material, the said steel sheet material consisting essentially of plain low carbon columbium treated steel initially having a total carbon content of at least 0.03% and containing about 0.03–0.15% of columbium, the sheet material being the flat rolled product of the solidification of molten steel of said composition, the carbon content of the steel being partially stabilized by the columbium whereby a portion of the carbon content is free to diffuse upon heating the sheet material to an elevated chromizing temperature, the sheet material being heat treatable at an elevated chromizing temperature in a protective chromizing atmosphere in the presence of a source of chromium and a chromizing energizer to produce a carbon-containing chromized coating thereon having a metallographically measured thickness of about 1–3 mils, the said chromized coating containing carbon from the steel sheet material which is free to diffuse, and the said carbon content which is free to diffuse, the columbium content and the thickness of the steel sheet material being correlated to satisfy the equation $$A = Y \times Z,$$

where $A$ is the percent carbon content of the said chromized coating and varies between 0.2 and 1%, $Y$ is the percent carbon content of the sheet material which is free to diffuse and is determined by the following equation $$\%\text{Diffusible Carbon} = \%\text{ Total Carbon} - \left[\frac{\%\text{ Columbium Content}}{8} + \frac{0.01\%}{1}\right]$$

and $Z$ is a multiplication factor determined by the equation $$\text{Multiplication Factor} = \frac{\text{The sheet material thickness in mils}}{\text{The total chromized coating thickness of the sheet material in mils}}$$

where the total chromized coating thickness of the sheet material is equal to twice the metallographically measured diffusion layer of the said chromized coating plus 1 mil.

16. The process of claim 15 wherein said sheet material is the flat rolled product of steel selected from the group consisting of semikilled steel, capped steel, rimmed steel and steel killed with aluminum.

17. The process of claim 15 wherein said A varies between about 0.25 and 0.50%.

18. The process of claim 15 wherein the said total carbon content of the sheet material is 0.04–0.06% and the columbium content is 0.06–0.08%.

19. The process of claim 18 wherein the thickness of the said sheet material is about 0.020–0.060 inch.

20. The process of claim 19 wherein said sheet material is the flat rolled product of steel selected from the group consisting of semikilled steel, capped steel, rimmed steel and steel killed with aluminum.

21. The process of claim 20 wherein said A varies between 0.25 and 0.50%.

* * * * *

UNITED STATES PATENT OFFICE
CERTIFICATE OF CORRECTION

Patent No. 3,969,550 Dated July 13, 1976

Inventor(s) Carl Adolph Beiser

It is certified that error appears in the above-identified patent and that said Letters Patent are hereby corrected as shown below:

Col. 2, line 51, "pf" should read -- of --;

Col. 3, line 1, "fo" should read -- of --;

Col. 3, line 1, "hereidnafter" should read --hereinafter--;

Col. 5, line 58, "temdporary" should read -- temporary --;

Col. 7, line 35, after "construction", omit "and especially high speed lines of prior art construction";

Col. 10, line 61, omit the comma (,) before "A" in equation;

Col. 11, line 55, "0.05" should read -- 0.06 --;

Col. 12, line 64, after "12", insert -- grams --;

Col. 12, line 65, after the period (.), omit "grams of";

Col. 13, line 9, "of" should read -- on --;

Col. 13, line 47, "passign" should read -- passing --;

Col. 16, line 62, "coating of liquid" should be --coating of a liquid --.

Signed and Sealed this

Twelfth Day of April 1977

[SEAL]

*Attest:*

RUTH C. MASON
*Attesting Officer*

C. MARSHALL DANN
*Commissioner of Patents and Trademarks*